US005307749A

United States Patent [19]

Kaiser

[11] Patent Number: 5,307,749

[45] Date of Patent: May 3, 1994

[54] PROCESS FOR DETERMINING THE COORDINATE VALUES FOR SEWING PATTERNS

[75] Inventor: Claus Kaiser, Karlsruhe; Fed. Rep. of Germany

[73] Assignee: G. M. Pfaff Aktiengesellschaft, Kaiserslautern, Fed. Rep. of Germany

[21] Appl. No.: 966,943

[22] Filed: Oct. 27, 1992

[30] Foreign Application Priority Data

Oct. 28, 1991 [DE] Fed Rep. of Germany ..... 4135472

[51] Int. Cl.[5] ..... D05B 3/02; D05B 21/00

[52] U.S. Cl. ..... 112/262.3; 112/266.1; 112/314; 112/456; 112/121.12

[58] Field of Search ..... 112/266.1, 262.3, 456, 112/453, 454, 457, 121.11, 121.12, 314, 323

[56] References Cited

U.S. PATENT DOCUMENTS

| | | | |
|---|---|---|---|
| 4,226,199 | 10/1980 | Adams | 112/323 X |
| 4,444,135 | 4/1984 | Yangai | D05B21/00 |
| 4,539,925 | 9/1985 | Shim | 112/314 |
| 4,982,674 | 1/1991 | Hayakawa | 112/266.1 X |
| 4,991,524 | 2/1991 | Ozaki | 112/457 X |

FOREIGN PATENT DOCUMENTS

| | | | |
|---|---|---|---|
| 2938294 | 4/1980 | Fed. Rep. of Germany | D05C 502 |
| 4027364 | 3/1992 | Fed. Rep. of Germany | D05B 19/00 |

*Primary Examiner*—Peter Nerbun
*Attorney, Agent, or Firm*—McGlew and Tuttle

[57] ABSTRACT

A process for determining coordinate values of touchdown sites of a needle for forming sewing patterns with an electronically controlled sewing machine, which is equipped with a feed dog performing only relatively small amounts of displacement and with a needle pivotable in one direction of displacement of the feed dog. The coordinate values for a straight seam section, the consecutive touchdown points of the needle, are determined when the maximum amount of feed of the feed dog in the X coordinate direction and/or the sum of the maximum amount of the lateral movement of the needle which is possible at a given needle position and the maximum amount of feed of the feed dog in the Y coordinate direction is exceeded. The seam section is subdivided by equidistant intermediate touchdown sites, the distances between which in the direction of movement of the needle are composed of a constant percentage of the lateral movement of the needle and of a constant feed percentage of the feed dog.

6 Claims, 6 Drawing Sheets a
b
c
d
e
f
V
V
yb
yc
yd
ye
yf
xb
xc
xd
xe
xf a
b
c
d
d1
e
e1
f
f1
f2
f3
f4
f5
f6
f7
V
V
V
yd2
yd1
xd1
xd2

PROCESS FOR DETERMINING THE COORDINATE VALUES FOR SEWING PATTERNS

FIELD OF THE INVENTION

The present invention pertains to a process for determining coordinate values of needle touchdown points for sewing patterns with an electronically controlled sewing machine, the sewing machine having a feed dog which extends through slots in a needle plate and is driven in both an X coordinate direction (corresponding to the normal direction of feed) and a Y coordinate direction (extending at right angles to the normal direction of feed), a drive for moving the needle in the Y coordinate direction wherein a data processor and a least one memory is provided for storing the coordinate values associated with the touchdown points.

BACKGROUND OF THE INVENTION

An electronically controlled household sewing machine, which is able to prepare sewing patterns whose width exceeds the normal width of the patterns stored, has become known from German Offenlegungsschrift DE-OS 40,27,364. These pattern combinations are prepared by a combination of individual sewing patterns with individual stitches, at least some of which can be prepared at right angles to the direction of sewing of the individual pattern. Even though freely programmable individual patterns can be prepared with this machine, the coordinates of every individual stitch must be entered by hand into the program memory during programming.

In the area of industrial machines, embroidery machines have been combined with personal computers. Various programming devices have been developed here in order to develop the coordinate values of the touchdown sites of an embroidery pattern. In these programming devices, the coordinate values, which form the desired sequence of touchdown sites of the needle in a workpiece, are entered by the operator by hand directly into a memory device for each stitch position, and entry is possible via a screen display unit.

To simplify entry, a device (West German Offenlegungsschrift No. DE-OS 32,32,842 corresponding to U.S. Pat. No. 4,444,135), in which only the coordinates of the two end points of a straight line or of an arc section are to be entered, rather than having to enter every individual pair of coordinate values by hand, has become known as well. The control device will subsequently automatically compute the coordinates of the missing touchdown points of the needle, and insert these between the end points of the curve section.

The said programming device is used in a sewing machine which is equipped with a fabric frame that is freely movable in the direction of the X and Y coordinates. The fabric frame is driven by stepping motors during the time during which the needle has been withdrawn from the fabric. Even though the duration of movement of the fabric frame is consequently limited, the magnitude of the movement in the two coordinate directions can be freely selected, insofar as this is permitted by the free mobility of the frame during the predetermined time.

It is not possible to apply the prior-art measure to a sewing machine, in which the fabric to be sewn is transported by a feed dog extending through slots in a needle plate, because only rather minimal fabric feed movements of the feed dog in the two coordinate directions can be performed by stitch formation cycles due to the dimensions of the slots being limited because of the sewing technology.

For this reason, satisfactory programming of the intermediate stitches is not possible with the prior-art solution in the case of a straight seam. Entering the consecutive stitches manually is also almost impossible because of the complicated relationships to be taken into account.

SUMMARY AND OBJECTS OF THE INVENTION

It is a primary object of the present invention to provide a process which simplifies the programming of the seam sections of a sewing pattern and optimally adjusts the preparation of the intermediate touchdown points to the conditions of feed of the material to be sewn, especially by utilizing the lateral movement of the needle in the coordinate direction in which the permissible movement of the feed dog is very minimal.

According to the invention, a process is provided for determining coordinate values of touchdown points of the needle for forming sewing patterns with an electronically controlled sewing machine. The electronically controlled sewing machine is provided with a feed dog which extends through slots in the needle plate and is driven in both an X coordinate direction, corresponding to the normal direction of feed, and in a Y coordinate direction, extending at a right angle to the normal direction of feed. A further drive is provided for moving the needle in the Y coordinate direction. A data processor and at least one memory are provided with the sewing machine for storing the coordinate values associated with the touchdown points. The process provides a seam section based on the determination of two consecutive touchdown points of a needle which is greater than a maximum amount of feed of the feed dog in the X coordinate direction and/or greater than the sum of the maximum amount of lateral movement of the needle, which is still possible for the seam section in question, and the maximum amount of feed of the feed dog in the Y coordinate direction. Coordinate values are determined for a predeterminable number of intermediate, preferably equidistant touchdown points, the value of the distance in the Y coordinate direction between a touchdown site and an intermediate touchdown site or between two intermediate touchdown sites is always determined by a constant percentage of the lateral movement of the needle and by a constant percentage of the maximum movement of the feed dog in the Y coordinate direction.

The process of the invention leads to optimal feed utilization of the sewing machine used and consequently to optimal division of the intermediate touchdown sites inserted, along with simple operation, and limitations in terms of the length and the direction of a straight stitch sequence that can be prepared within one sewing pattern are due only to inaccuracies in the feed behavior of the feed dog being used.

The process of the invention is characterized by process steps for determining the coordinate values of intermediate touchdown sites including:

a) determination of the coordinate values of the two touchdown sites of the seam section;

b) determination of the X coordinate section and Y coordinate section of the seam section;

c) determination of the number of intermediate touchdown sites for the X coordinate section;
d) determination of the amount of lateral movement of the needle which is still possible in the predetermined X coordinate direction;
e) determination of the necessary number of intermediate touchdown sites for the Y coordinate section after subtracting the still possible amount of lateral movement of the needle;
f) determination of the number of intermediate touchdown sites to be formed by comparing the number of intermediate touchdown sites determined in the two coordinate directions;
g) determination of the amount of feed of the feed dog per stitch formation cycle in the X coordinate direction; and
h) determination of the amount of the lateral movement of the needle per stitch formation cycle;

this offers an unambiguous sequence of steps for solving the process.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
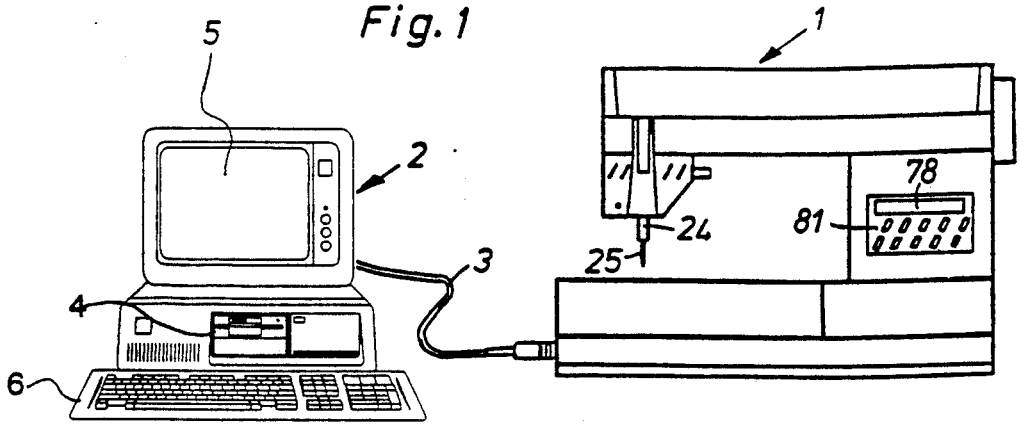
FIG. 1 is a schematic representation of a sewing machine with a personal computer connected to it.

The arrangement according to FIG. 1 includes an electronic sewing machine 1 with a microprocessor system, with a memory and a PC (Personal Computer) 2, which is connected to the sewing machine 1 via a connection cable 3. The PC 2 contains, in the known manner, a disk drive 4 for receiving prior-art diskettes, a display screen 5 for displaying sewing patterns and operating instructions, as well as a keyboard 6 for operating the PC 2.

Figure 4:
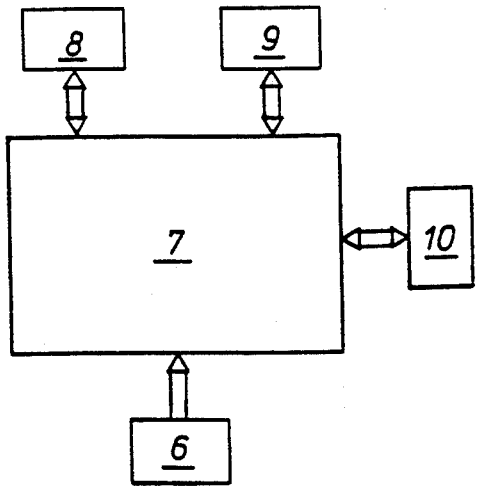
FIG. 4 is a simplified block diagram of the electronic control circuit of the PC.

The PC 2 also has a CPU 7 (FIG. 4), to which, e.g., the keyboard 6, a working memory 8, a control unit 9 for the display screen 5, and a port 10 for the connection cable 3 are connected.

Control data for controlling the PC 2 and the sewing machine 1, as well as stitch data for preparing a sewing pattern can be entered with the keyboard 6. The display unit 5 serves to display the stitch sequence of a sewing pattern stored in the memory in the sewing machine 1, to display control data entered via the keyboard 6, and to display a stitch sequence of a sewing pattern to be prepared, which stitch sequence is entered by means of the keys of the keyboard 6.

The display of the sewing pattern on the display screen 5 corresponds, on an enlarged scale, to the sewing pattern subsequently prepared with the sewing machine 1 on the fabric being sewn. Using the keyboard 6, the sewing pattern displayed on the display screen 5 can be modified in agreement with the data entered via the keyboard 6. On conclusion of the entries via the keyboard 6, the data entered into the PC 2 are transmitted to the memory of the sewing machine 1 via the connection cable 3, and they are available for preparing the pattern by the sewing machine 1.

Figure 2:
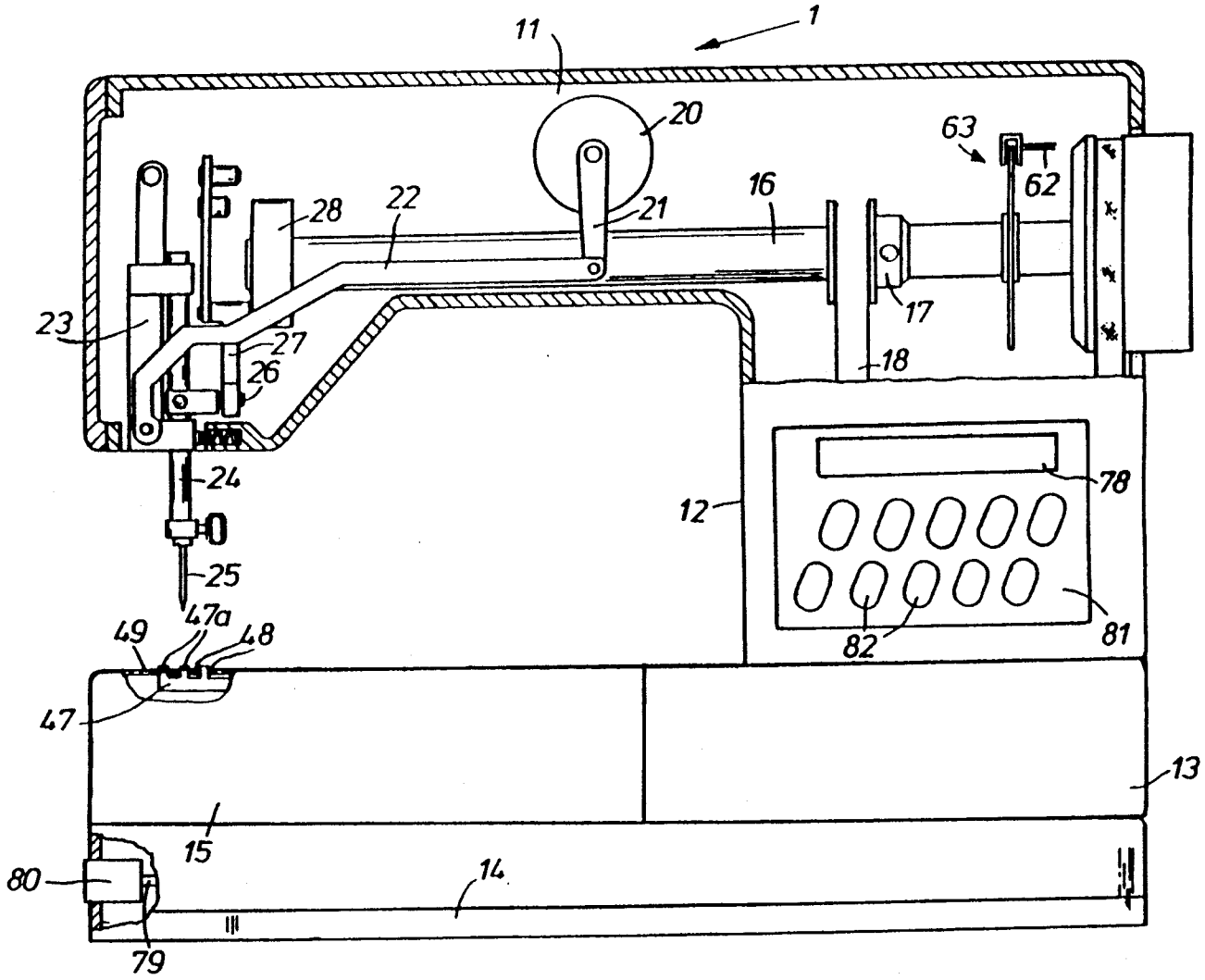
FIG. 2 is a front partially sectional the view of the sewing machine with electronic control.

The sewing machine represented in FIG. 2 has an arm 11, which is connected to a base 13 via a stand 12. The base 13 is held by a base plate 14 and has a flap 15, in order to make accessible the lower stitch-forming tools accommodated in the base 13, especially the shuttle of the sewing machine.

Figure 3:
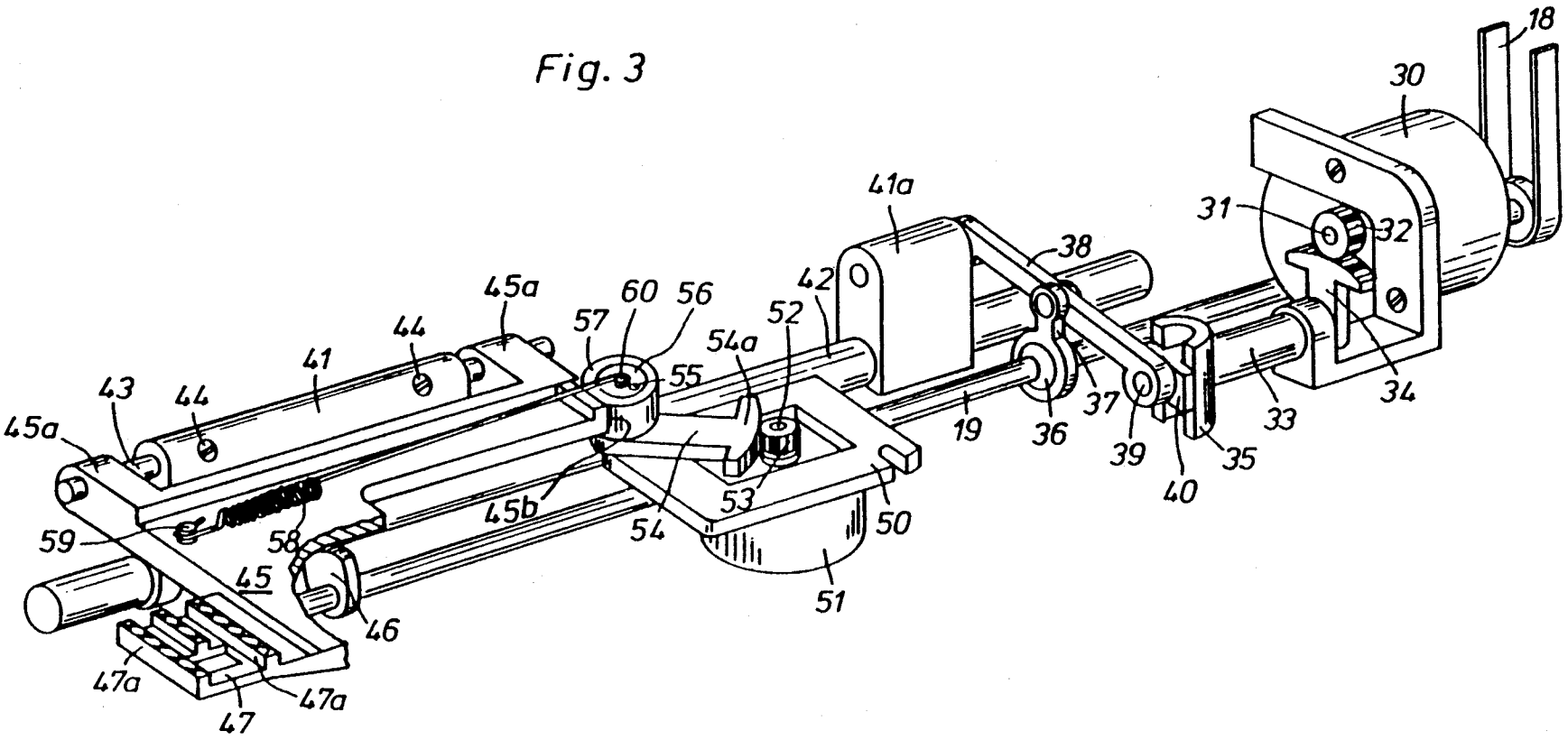
FIG. 3 is an enlarged schematic representation of the drive unit for driving the feed dog.

A main shaft 16, mounted in the arm 11 of the sewing machine, drives, via a gear 17 and a toothed belt 18, a lower shaft 19 (cf. FIG. 3), which serves to drive the shuttle in the known manner, not shown.

A stepping motor 20, which is connected to a needle bar pendulum 23 via a crank 21 and a connecting rod 22, is provided in the arm 11. The needle bar pendulum 23 is hinged with a bolt in the arm 11, and it carries a vertically movable needle bar 24 with a needle 25. The needle bar 24 is rigidly connected to a pin 26, on which acts a guide rod 27, which is hinged to a crank 28 attached to the main shaft 16.

A stepping motor 30 (cf. FIG. 3), whose shaft 31 drives a toothed segment 34 attached to an adjusting shaft 33 via a pinion 32, is fixed in the base 13. A connecting link guide 35 is attached to the free end of the adjusting shaft 33.

A cam 36, which is surrounded by a cam rod 37 that is hinged in the middle part of a push rod 38, is attached to the shaft 19. This push rod 38 is connected, at one end, via a pin 39, to a sliding block 40, which is rotatably mounted on the pin 39 and cooperates with the connecting link guide 35 in the known manner. The other end of the push rod 38 is connected to a rocker arm 41*a* of a feed rocker 41, which is held by an axle 42 mounted in the lower arm 13.

An axle 43 is fastened by means of screws 44 in a bore of the feed rocker 41. On the axle 43, a support 45 is pivotably and displaceably mounted via lugs 45*a*. The support 45, which is supported on a lifting arm 46 attached to the shaft 19, is rigidly connected to a feed dog 47.

To feed fabric to be sewn, the feed dog 47 is equipped with feed webs 47*a*, which act on the fabric to be sewn through slots 48 (cf. FIG. 2) provided in a needle plate 49 covering the base 13 in the area of the stitch formation site. The slots 48 are designed such that the feed webs 47*a* of the feed dog 47 are able to perform displacing movements in both the normal feed direction designated by the X coordinate direction and at right angles thereto, in the direction designated as the Y coordinate direction, i.e., at right angles to the normal feed direction.

A stepping motor 51, on the output shaft 52 of which a pinion 53 is attached, is fastened by screws in a plate 50 (FIG. 3) held by the base 13. This stepping motor 51 and output shaft 52 are in drive connection with a toothed segment 54*a* of a rocker 54, which is mounted on a pin 55 attached to the plate 50. An area turned out on the rocker 54 surrounding the pin 55 is designed as a cam 56, whose axis extends outside the axis of the axis of the pin 55. A sleeve 57, with which a lateral surface 45*b* of the support 45 is in contact under the action of a tension spring 58, is rotatably mounted on the cam 56. This tension spring 58 is attached, at one end, to a pin 59 fastened to the support 45, and to a bolt 60, which is fastened in the axis of the cam 56, at the other end.

Figure 5:
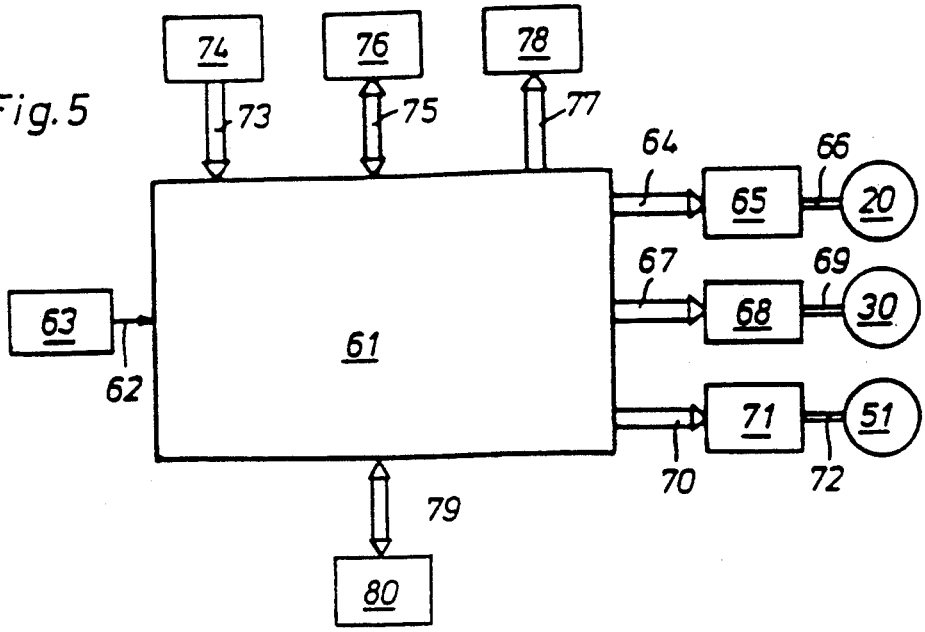
FIG. 5 is a block diagram of the control system of the electronically controlled sewing machine.

A microcomputer 61 (FIG. 5), which is connected to a pulse generator 63 driven synchronously by the main shaft 11 of the sewing machine 1 via lines 62, is accommodated in the housing of the sewing machine 1. The pulse generator 63 sends a pulse to the microcomputer 61 during each revolution of the machine when the needle 25 has left the fabric being sewn and the stepping motor 20 is able to adjust the position of the needle bar 24, and also when the feed dog 47 has concluded its feed movement and the stepping motors 30 and 51 are able to control a new amount of feed. A needle deflection control unit 65, which is connected to the stepping motor 20 via lines 66, is connected to the microcomputer 61 via lines 64. The microcomputer 61 is connected to a forward/reverse control unit 68 via lines 67, and the forward/reverse control unit 68 is connected to the stepping motor 30 via lines 69. Finally, the microcomputer 61 is connected via lines 70 to a crossfeed control unit 71 to perform a crossfeed in the Y coordinate direction, and this crossfeed control unit 71 is connected to the stepping motor 51 via lines 72.

A read-only memory (ROM) 74 is connected to the microprocessor via lines 73, and working memory (RAM) 76 is connected via lines 75, and a display unit 78 is connected via lines 77. In addition, a jack 80 is connected to the microcomputer 61 via a line 79 in order to establish the connection between the PC 2 and the sewing machine 1.

The three stepping motors 20, 30, and 51 are identical in terms of their design and their general control. The stepping motor 20 serves to control the lateral movement of the needle bar pendulum 23 in the Y coordinate direction; the stepping motor 30 serves to control the pushing movement of the feed dog 47 in the X coordinate direction, and the stepping motor 51 serves to control the pushing movement of the feed dog 47 in the Y coordinate direction.

A control panel 81 (FIG. 2) is attached to the front side of the housing of the sewing machine 1. In this panel 81 there is accommodated the display unit 78, in which operating instructions or displays can be made visible. The rest of the control panel 81 has pushbuttons 82 for operating the sewing machine 1.

A desired stitch sequence or a sewing pattern is entered via the keyboard 6 of the PC. The selected course of the consecutive touchdown sites is displayed as dots a, b, c, . . . (FIG. 7*a*) on the display screen, and any two adjacent dots are connected by a connection line V representing the subsequent course of the thread. The connection V of two dots a, b or b, c, etc., represents a straight seam section. Assuming that the feed dog 47 in the X coordinate direction is able to perform a maximum feed of 6 mm in the X coordinate direction and a maximum crossfeed of 1 mm in the Y coordinate direction, and that the needle is also able to be deflected by a maximum amplitude of 9 mm, the stitch distribution shown in FIG. 7*b* will be obtained.

Figure 7A:
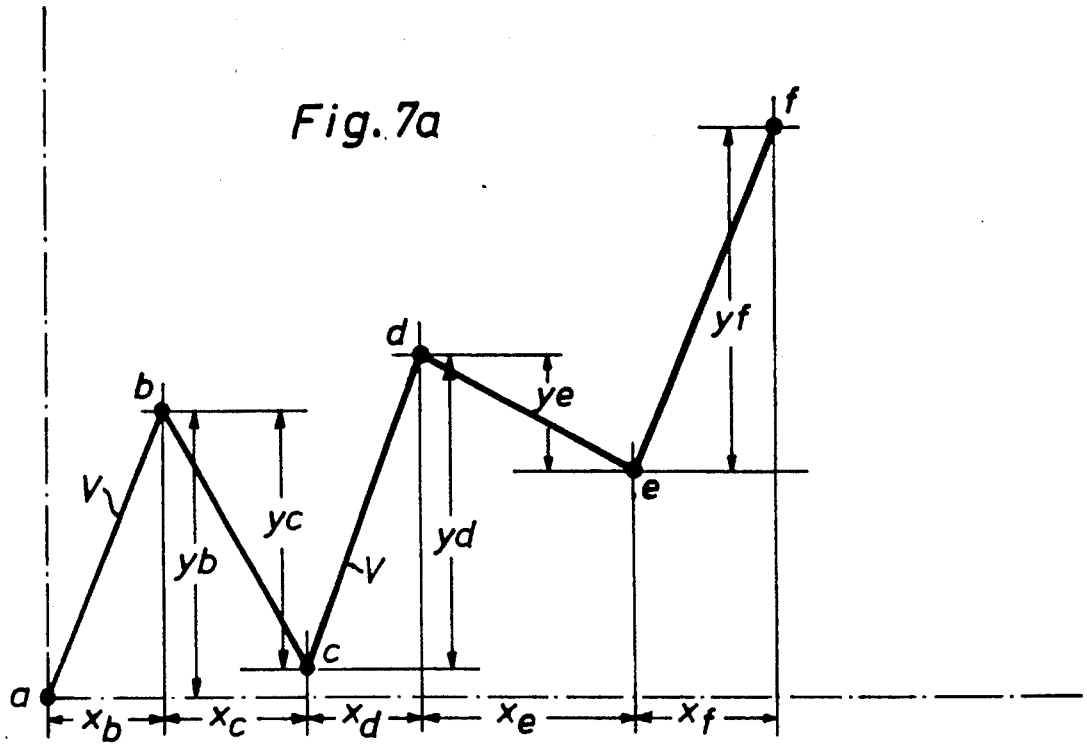
FIG. 7*a* is an enlarged representation of a stitch sequence for explanation of characteristics of the present invention.

The touchdown site b in FIG. 7*a* is offset by the amount xb=4 mm in the X coordinate direction and by the amount yb=10 mm in the Y coordinate direction in relation to the touchdown site a. Consequently, the maximum possible amount of feed of the feed dog 47 in the X coordinate direction is not exceeded, and the maximum amount of needle deflection of 9 mm and the maximum amount of crossfeed of the feed dog 47, equaling 1 mm, are only just not exceeded, so that the stitch offset from the touchdown site a to the touchdown site b can be performed during a single stitch formation cycle.

The distance between the touchdown site c and the touchdown site b is xc=5 mm in the X coordinate direction and yc=9 mm in the Y coordinate direction. The offset between the touchdown sites b and c can be filled out by the feed dog 47 in the X coordinate direction and only by the possibility of deflection of the needle 25 in the Y coordinate direction, so that the needle 25 is deflected by the amount of 9 mm to the right, without participation of the crossfeed of the feed dog 47.

Figure 7B:
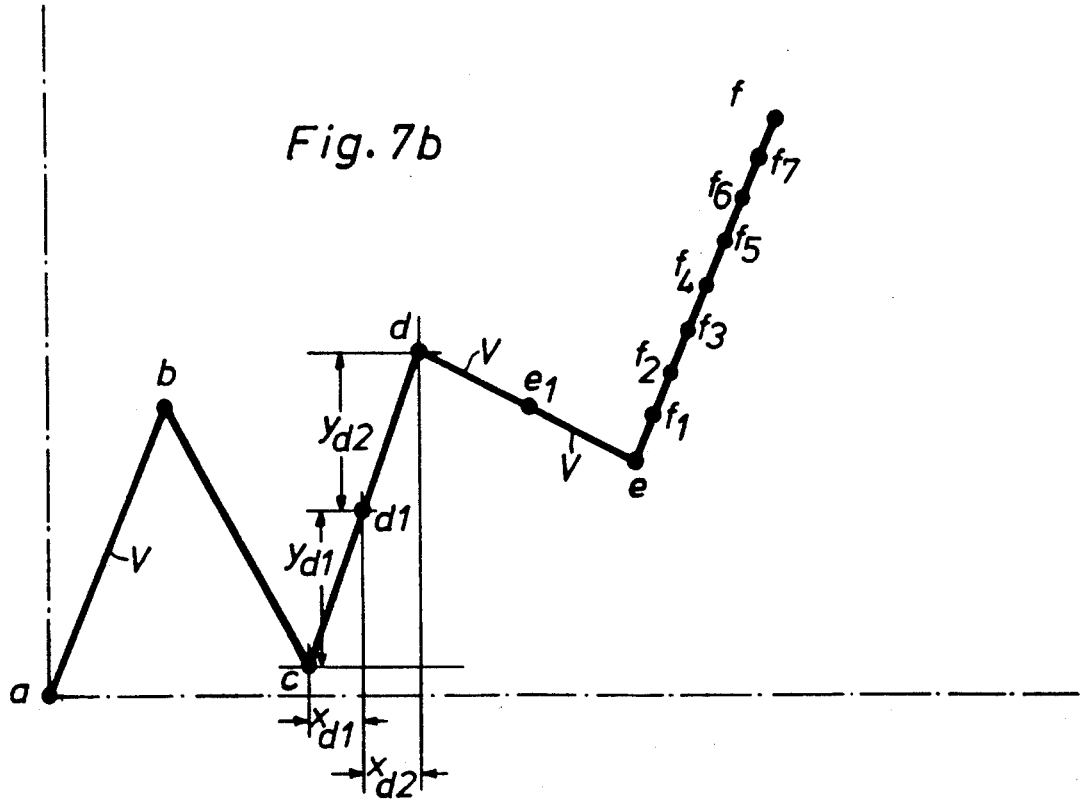
FIG. 7*b* is the stitch sequence according to FIG. 7*a* with intermediate steps inserted.

The distance between the touchdown site d and the touchdown site c is xd=4 mm in the X coordinate direction and yd=11 mm in the Y coordinate direction. While the displacement of the fabric being sewn can be performed by the feed dog 47 in the X coordinate direction without problems during a single stitch formation cycle in this case as well, stitch offset in the Y coordinate direction during a single stitch formation is impossible. The needle 25, which is in its right end position, is able to manage the offset by 9 mm; the remaining 2 mm are performed with two crossfeeds of 1 mm each of the feed dog 47. As a result, an intermediate touchdown site d1 is inserted, as is shown in FIG. 7*b*.

The distance between the touchdown site e and the stitch d is xe=7.5 mm in the X coordinate direction and ye=4 mm in the Y coordinate direction. The maximum possible amount of feed of the feed dog 47 in the X coordinate direction is consequently insufficient, so that an intermediate touchdown site e1 is necessary. The needle 25 is deflected by 2 mm to the right in the Y coordinate direction during both stitch formation cycles, so that it will penetrate into the fabric at the touchdown site e2 in a position located at a distance of 5 mm from its right end position.

The distance between the touchdown site f and the touchdown site e is xf=5 mm in the X coordinate direction and yf=12 mm in the Y coordinate direction. The amount xf would be able to be achieved during one feed stroke of the feed dog 47. However, the offset by the amount yf requires a plurality of stitch formations. Since the needle 25 is in a position located at a distance of 5 mm from its right position, it is able to be deflected by an additional 4 mm to the left, so that the feed dog 47 still has to push the fabric by an amount of 12−4=8 mm in the Y coordinate direction. The offset from the touchdown site e to the touchdown site f consequently requires eight stitch formations f8, of which the feed dog 47 assumes 1 mm each in the Y coordinate direction and the needle 25 assumes 0.5 mm each. Consequently seven intermediate touchdown sites f1, f2, . . . f7 must be inserted.

Figure 6A:
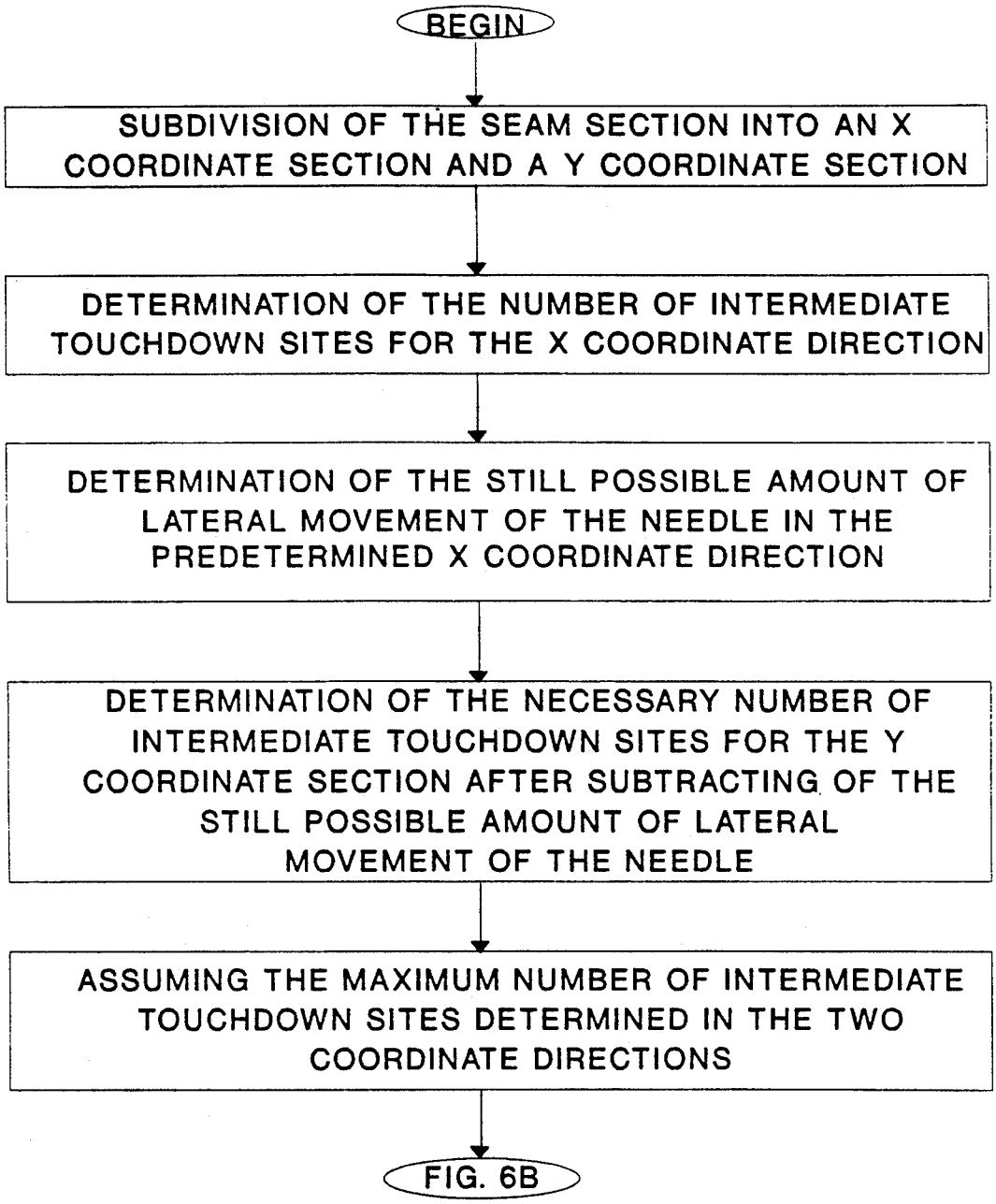
FIGS. 6A and 6B are a flow chart of the operation of the control circuit of the PC.
Figure 6B:
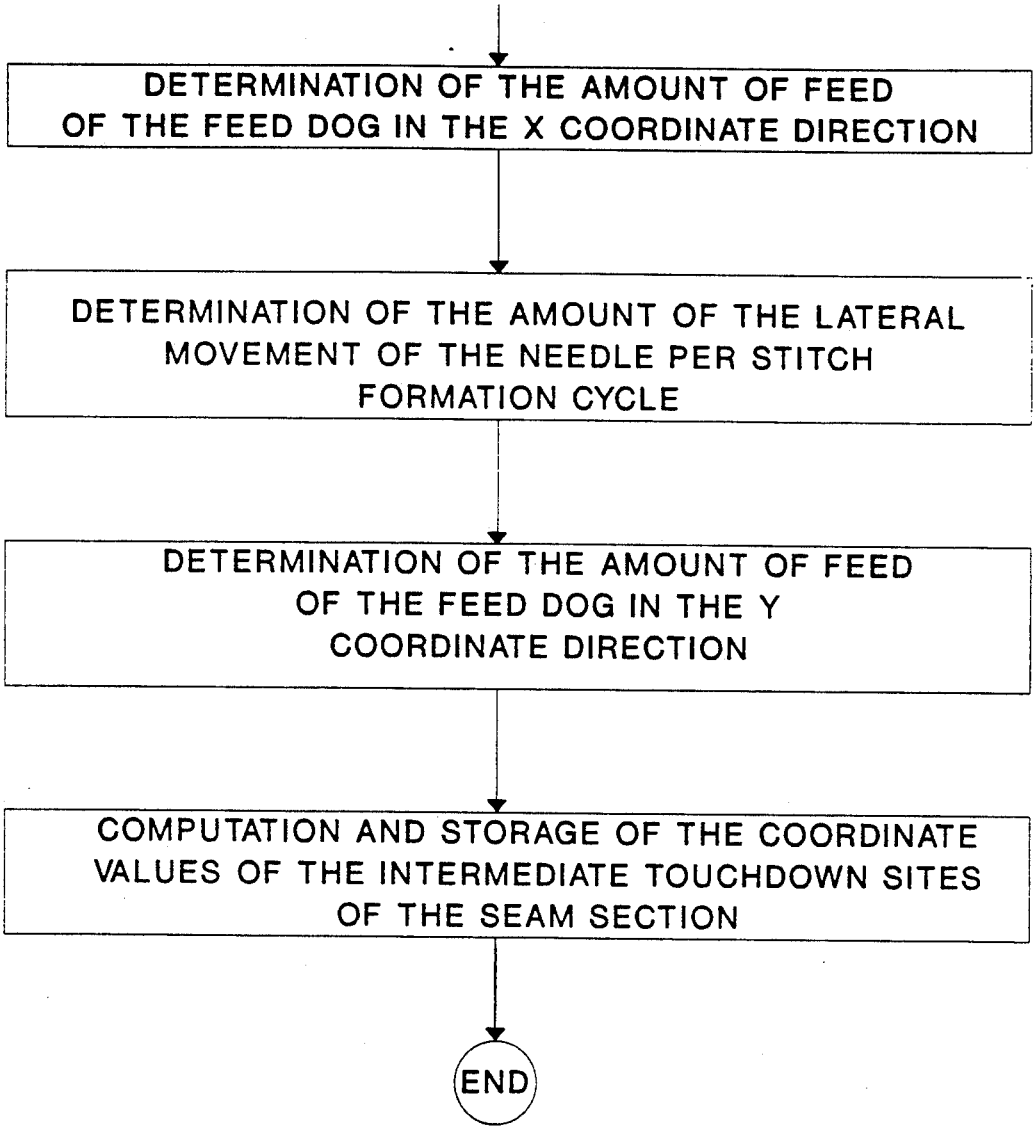

On entry of each touchdown point a, b, c, . . . , the CPU 7 (FIG. 4) of the PC 2 computes the coordinate values corresponding to the respective touchdown points, and is subsequently able to check whether the displacement of fabric that can be performed by the feed dog 47 during the performance of one stitch formation cycle is sufficient for performing the computed feed change of the fabric being sewn and/or the deflection movement of the needle 25 in relation to the preceding pair of coordinate values. If this is impossible, the CPU 7 of the PC 2 runs a program corresponding to the sequence shown in the flow chart according to FIGS. 6A and 6B. The seam section is first divided into its X coordinate section and its Y coordinate section. The number of the necessary feed movements of the feed dog 47 for the X coordinate section, which feed movements do not exceed the maximum amount of feed during one stitch formation cycle, is then determined. The amount of deflection of the needle 25, which is still possible in the predetermined Y coordinate direction, is subsequently determined. The amount of deflection of the needle 25 which is still possible is subtracted from the Y coordinate section, and the number of the necessary feed movements of the feed dog 47 for the Y coordinate section, which feed movements do not exceed the maximum amount of feed during one stitch formation cycle, is determined from the remainder. The maximum number is assumed from the number of the feed movements determined in the two coordinate directions. Then, a uniform, effective amount of feed to be performed by the feed dog 47 in the X coordinate direction, the deflecting movement of the needle 25, which is to be performed during each feed movement in the Y coordinate direction, as well as a uniform, effective amount of feed of the feed dog 47, which is to be performed in the Y coordinate direction, are computed. Finally, the consecutive coordinate values of the seam section are computed from the effective feed movements of the feed dog 47 in the X and Y directions and from the components of the deflecting movement of the needle 25 computed in the Y coordinate direction, after which these coordinate values are sent by the CPU 7 into the working memory 8.

On completion of the programming, the consecutive coordinate values of the stitch sequence generated can be saved to a diskette from the working memory 8 via the keyboard 6 of the PC 2, or they are sent to the working memory 76 of the sewing machine I via the connection cable 3.

During the sewing of the stitch sequence, the coordinate data of the programmed sewing pattern are successively polled by the microcomputer 61. The microcomputer 61 now controls the stepping motor 20 or the lateral pendular movements of the needle bar pendulum 23 via the needle deflection control unit 65, the stepping motor 30 for the feed movement of the feed dog 47 in the X coordinate direction via the forward/reverse control unit 68, and the stepping motor 51 for moving the feed dog 47 in the Y coordinate direction via the crossfeed control unit 71 in the programmed sequence.

To perform the stitch formation, the stepping motor 20 pivots the needle bar pendulum 23 into the new deflected position for the needle 25 via the crank 21 and the connecting rod 22 as soon as the needle 25 has left the fabric being sewn. The stepping motor 30 adjusts the connecting link guide 35 via the pinion 32 and the toothed segment 34. The sliding block 40 is pushed to and fro in the connecting link guide 35 during the deflecting movement of the pin 39 by the cam rod 37. Corresponding to the angular adjustment of the connecting link guide 35, which is predetermined for it by the stepping motor 30, the sliding block 40 pivots the feed rocker 41 via the push rod 38, thus imparting to the feed dog 47 feed movements in the X coordinate direction, whose amount and direction depend on the angular position of the connecting link guide 35.

Synchronously with the rotation of the main shaft 16, the lifting cam 46 is driven via the shaft 19 and imparts lifting movements to the feed dog 47.

To displace the fabric being sewn in the Y coordinate direction, the stepping motor 51 drives the rocker 54 via the pinion 53, as a result of which the cam 56 will laterally displace the support 45 via the sleeve 57 against the action of the tension spring 58. The feed webs **47*a* of the feed dog 47 connected to it will then carry the fabric to be sewn at right angles to the normal direction of feed during their lateral displacement. This displacement takes place synchronously with the normal feed movement of the feed dog 47, i.e., during the phase during which the feed webs 47*a* of the feed dog are raised above the needle plate 49**.

While a specific embodiment of the invention has been shown and described in detail to illustrate the application of the principles of the invention, it will be understood that the invention may be embodied otherwise without departing from such principles.

What is claimed is:

1. A process for determining coordinate values of needle touchdown points for forming sewing patterns with an electronically controlled sewing machine, which has a feed dog which extends through slots in a needle plate and is driven in both an X coordinate direction corresponding to a normal direction of feed and in a Y coordinate direction extending at right angles to the normal direction of feed, a drive for moving the needle in the Y coordinate direction, as well as a data processor and a least one memory for storing the coordinate values associated with touchdown points, the process comprising the steps of:

detecting a seam section which must be divided into needle touchdown points, which seam section is determined by two consecutive touchdown points of a needle and which seam section is greater in length than a maximum amount of feed of the feed dog in the X coordinate direction and/or greater than a sum of the maximum amount of lateral movement of the needle which is possible at a particular needle position and a maximum amount of feed of the feed dog in the Y coordinate direction;

dividing a seam section detected by determining coordinate values for a predeterminable number of intermediate, substantially equidistant touchdown points wherein a value of the distance in the Y coordinate direction between a touchdown point and an intermediate touchdown point or between two intermediate touchdown points is always determined by a constant percentage of lateral movement of the needle and by a constant percentage of said maximum movement of the feed dog in the Y coordinate direction;

generating an electrical signal to drive said needle and said feed dog for forming a seam based on said coordinate values determined for each seam section detected.

2. The process according to claim 1, further comprising:

determining coordinate values of said intermediate touchdown points of said seam section by:

a) determining coordinate values of two touchdown points of the seam section;

b) determining the X coordinate section and the Y coordinate section of said seam section;

c) determining a number of intermediate touchdown points for the X coordinate section;

d) determining an amount of lateral movement of the needle which is at a given needle position in the predetermined Y coordinate direction;

e) determining a necessary number of intermediate touchdown points for said Y coordinate section after subtracting said still possible amount of lateral movement of the needle;

f) determining a number of intermediate touchdown points to be formed by comparing said number of intermediate touchdown sites determined for said Y coordinate section and said X coordinate section;

g) determining an amount of feed of said feed dog per stitch formation cycle in said X coordinate direction;

h) determining an amount of lateral movement of said needle per stitch formation cycle;

i) determining an amount of feed of said feed dog per stitch formation cycle in the Y coordinate direction, taking into account the computed amount of the lateral movement of the needle; and j) computing and storing said coordinate values of said intermediate touchdown points of said seam section.

3. A process for determining coordinate values of touchdown sites of a needle for forming sewing patterns with an electronically controlled sewing machine, the sewing machine being equipped to effect a needle movement in a needle direction and a feed dog movement in a normal feed direction, at right angles to said needle direction, and said feed dog also being moveable in said needle direction, the process comprising the steps of:

determining if the distance between consecutive touchdown points of the needle for a straight seam section exceeds a maximum amount of feed of the feed dog in the normal feed direction and/or the sum of the still possible maximum amount of lateral needle movement which is possible at a particular needle position and the maximum amount of feed of the feed dog in the needle direction;

subdividing the seam section by equidistant intermediate touchdown sites wherein the distances between said sites, in the needle movement direction are made by a constant percentage of movement of the needle and a constant percentage of movement of the feed dog;

generating an electrical signal for driving said needle and said feed dog for forming a seam based on said intermediate touchdown sites for each straight seam determined.

4. A device for determining coordinate values of needle touchdown points for forming sewing patterns, comprising:

an electronically controlled sewing machine including a feed dog extending through slots in a needle plate, said feed dog being drivable in an X coordinate direction corresponding to a normal direction of feed and in a Y coordinate direction extending at right angles to the normal direction of feed and including a drive for moving the needle in the Y coordinate direction;

a computer connected to said electronically controlled sewing machine via cable means for electronically controlling said electronically controlled sewing machine via said computer;

a keyboard connected to said computer for entering sewing patterns, each sewing pattern having one or more seam sections;

display means connected to said computer for displaying sewing patterns entered and a central processing unit associated with said computer for decomposing seam sections of an entered sewing pattern into X and Y coordinate points, determining if the distance between consecutive touchdown points for a straight seam section exceed one of a maximum amount of feed of the feed dog in the X direction and the sum of a maximum amount of needle movement at a particular needle position plus the maximum amount of feed of the feed dog in the Y direction and subdividing the seam section by equidistant intermediate touchdown sites wherein distances between said sites, in the needle movement direction are based on a constant percentage of movement of the needle and a constant percentage of movement of the feed dog and storing said intermediate touchdown sites digitally in a digital storage means associated with said computer.

5. A device according to claim 4, wherein:

said computer storage means includes a disc drive for storing the sequence of coordinate values forming said equidistant intermediate touchdown sites.

6. A process for determining coordinate values of needle touchdown points for forming sewing patterns with an electronically controlled sewing machine, which has a feed dog which extends through slots in a needle plate and is driven in both an X coordinate direction corresponding to a normal direction of feed and in a Y coordinate direction extending at right angles to the normal direction of feed, a drive for moving the needle in the Y coordinate direction, as well as a data processor and a least one memory for storing the coordinate values associated with touchdown points, the process comprising the steps of:

dividing a seam section, which seam section is determined by two consecutive touchdown points of a needle and is greater in length than a maximum amount of feed of the feed dog in the X coordinate direction and/or greater than the sum of the maximum amount of lateral movement of the needle which is possible at a particular needle position and a maximum amount of feed of the feed dog in the Y coordinate direction;

providing means for calculating the number of necessary feed movements of the feed dog between the touchdown points of the said seam section after subtracting the possible lateral movement of the needle in the direction of the Y coordinate; and providing means for adjusting the amount of feed movement of the feed dog by an amount corresponding to the lateral movement of the needle in the direction of the Y coordinate for moving over equal distances between two intermediate touchdown points.

* * * * *